US010119284B1

(12) United States Patent
Dunlap

(10) Patent No.: US 10,119,284 B1
(45) Date of Patent: Nov. 6, 2018

(54) WAVE GENERATOR

(71) Applicant: Ryan M. Dunlap, Virginia Beach, VA (US)

(72) Inventor: Ryan M. Dunlap, Virginia Beach, VA (US)

( * ) Notice: Subject to any disclaimer, the term of this patent is extended or adjusted under 35 U.S.C. 154(b) by 0 days.

(21) Appl. No.: 15/666,875

(22) Filed: Aug. 2, 2017

(51) Int. Cl.
*E04H 4/12* (2006.01)
*E04H 4/00* (2006.01)
*A63B 69/12* (2006.01)

(52) U.S. Cl.
CPC ..... *E04H 4/0006* (2013.01); *A63B 69/125* (2013.01)

(58) Field of Classification Search
CPC .. A63B 69/0093; A63B 69/125; E04H 4/0006
USPC ..... 405/79; 4/491
See application file for complete search history.

(56) References Cited

U.S. PATENT DOCUMENTS 490,484 A * 1/1893 MacKaye ..... A63J 5/00 4/491
586,983 A * 7/1897 Wharton, Jr. ..... E04H 4/0006 366/261
1,763,491 A * 6/1930 Voltz ..... E04H 4/0006 4/491
2,002,043 A * 5/1935 Price ..... E04H 4/0006 4/491
3,350,724 A * 11/1967 Leigh ..... E04H 4/0006 4/491
3,973,405 A * 8/1976 Duport ..... E02B 1/02 4/491
4,062,192 A * 12/1977 Biewer ..... E04H 4/0006 4/491
4,170,898 A * 10/1979 Salter ..... G01M 10/00 4/491
4,507,018 A * 3/1985 Andersen ..... E02B 3/00 4/491
4,810,129 A * 3/1989 Guevel ..... E04H 4/0006 4/491
4,976,570 A * 12/1990 Davis ..... F04D 35/00 4/491
2005/0084333 A1* 4/2005 Zadig ..... F03B 13/187 405/79
2012/0183353 A1* 7/2012 Davis ..... A63G 31/007 405/79

FOREIGN PATENT DOCUMENTS

EP 293831 A1 * 12/1988

* cited by examiner

*Primary Examiner* — Frederick L Lagman
(74) *Attorney, Agent, or Firm* — William G. Sykes

(57) ABSTRACT

A wave generator which may e.g. rest on a deck of a concrete swimming pool is disclosed. The wave generator may include a chassis for support of other components, have structure for engaging a supporting environmental surface or object, an agitator to be periodically projected into the water, and an oscillating device for periodically projecting the agitator into the water and withdrawing the agitator from the water to enable subsequent impingements against the water. The oscillating device includes a rocker arm, a powered crank mechanism to rock the rocker arm, and a support arm to hold the agitator below the elevated end of the rocker arm, thus enabling the agitator to impinge against the surface of the water. Optionally, functional components of the wave generator are covered by a cover simulating e.g. a whale. Optionally, the wave generator includes a protective cage held in the water below the agitator.

12 Claims, 3 Drawing Sheets

WAVE GENERATOR

FIELD OF THE DISCLOSURE

The present disclosure relates to a wave generating machine for use e.g. in a swimming pool.

BACKGROUND

It has long been a desire to cause swimming pools and other bodies of water simulate waves of the ocean and large lakes. Machines have been developed for this purpose. These machines are typically large, and may be built into a swimming pool or other body of water.

There remains a need for a smaller, portable wave generator which will generate waves large enough to satisfy the interest of children, but which may be small enough not to present significant safety issues to children.

SUMMARY

The disclosed concepts address the above stated situation by providing a wave generator which may rest on a deck of a concrete swimming pool, or which may be readily fastened to a dock, a pier, a boat, the wall of a free-standing swimming pool, natural ground beside a natural body of water, or to other potential environmental objects and supporting surfaces. Such a wave generator may include a chassis for support of other components, and having structure for engaging an environmental surface or object, an agitator to be periodically projected into the water, and an oscillating device for periodically projecting the agitator into the water and withdrawing the agitator from the water to enable subsequent impingements against the water. In one example of a wave generator according to the present disclosure, the oscillating device includes a rocker arm, a powered crank mechanism to rock or oscillate the rocker arm, and a support arm to hold the agitator sufficiently low below the rocker arm as to enable the wave generator to rest on an environmental object or surface above the level of the water, while enabling rocking by the rocker arm to cause the agitator to impinge against the surface of the water.

Optionally, functional components of the wave generator such as the oscillating device and rocker arm are covered by a cover simulating for example, a whale.

Optionally, the wave generator includes a cage located to receive the agitator when the latter impinges against and penetrates the water, to prevent unintended and potentially hazardous contact between the agitator and a person in the water.

It is an object to provide improved elements and arrangements thereof by apparatus for the purposes described which is inexpensive, dependable, and fully effective in accomplishing its intended purposes.

These and other objects will become readily apparent upon further review of the following specification and drawings.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

DETAILED DESCRIPTION

Figure 1:
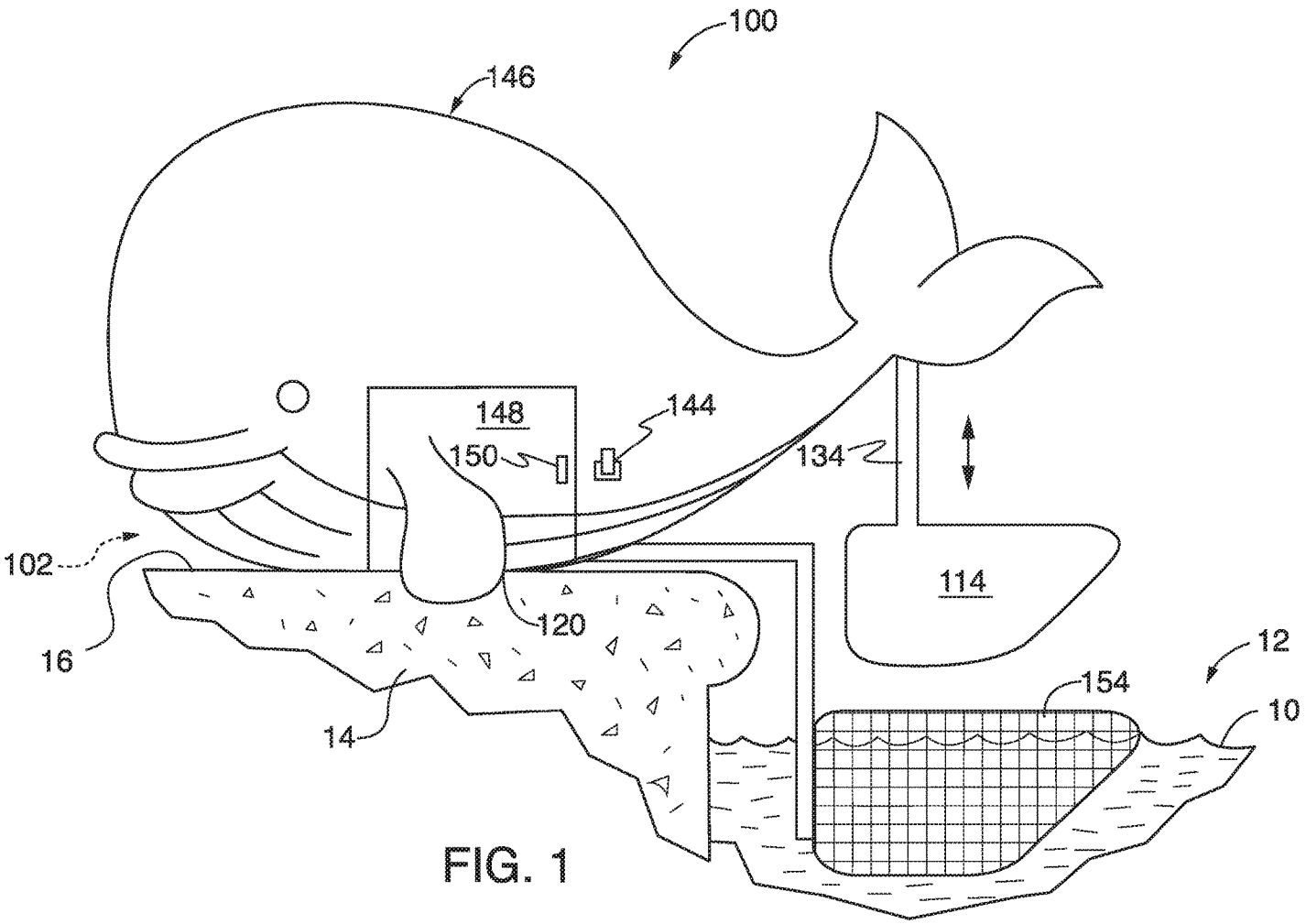
FIG. 1 is a schematic environmental side view of a wave generator, showing an agitator in an elevated position, according to at least one aspect of the disclosure.
Figure 2:
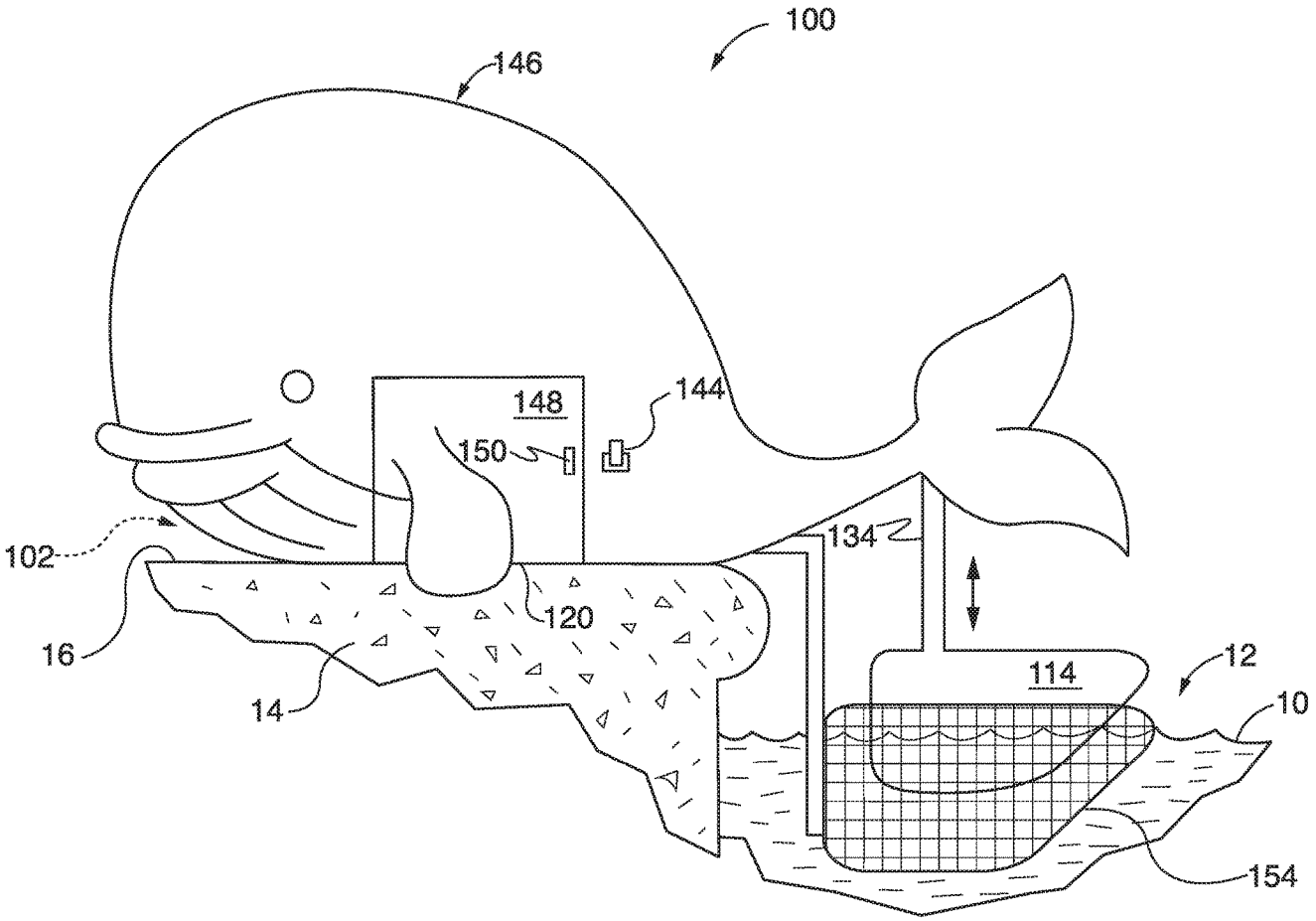
FIG. 2 is a schematic environmental side view of the wave generator of FIG. 1, showing the agitator in a lowered position, according to at least one aspect of the disclosure.
Figure 3:
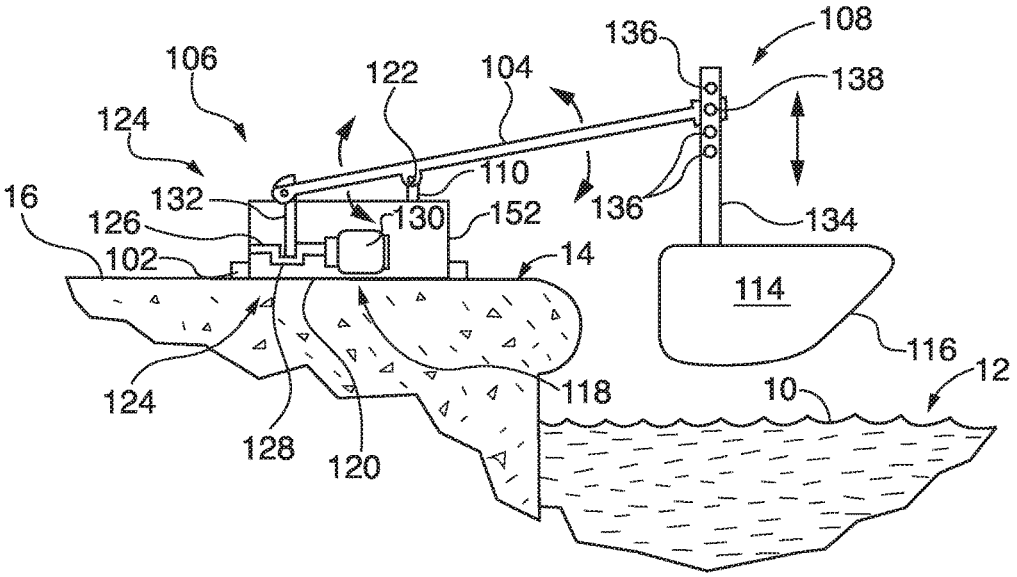
FIG. 3 is a schematic environmental side view of the wave generator of FIG. 1, with a cover removed to reveal internal detail, according to at least one aspect of the disclosure.

Referring first to FIGS. 1-3, according to at least one aspect of the disclosure, there is shown a wave generator 100 for generating waves on the surface 10 of a body of water 12 when supported on an environmental object 14 proximate body of water 12. Wave generator 100 comprises a chassis 102 including an environmental support configured to engage environmental object 14 and secure wave generator 100 stably thereto. Wave generator 100 comprises a rocker arm 104 including a proximal end 106 and a distal end 108, and a post 110 pivotally supporting rocker arm 104 above chassis 102 such that distal end 108 of rocker arm 104 extends laterally beyond chassis 102. Wave generator 100 further comprises an oscillating device 112 supported on chassis 102 and coupled to rocker arm 104 between proximal end 106 of rocker arm 104 and post 110, and an agitator 114 depending from rocker arm 104 between post 110 and distal end 108 of rocker arm 104. Agitator 114 is configured to present a contact surface 116 for generating a wave responsive to agitator 114 being projected into surface 10 of body of water 12. Agitator 114 may be a hollow object molded from a plastic material, for example. Contact surface 116 may be inclined to direct waves away from a wall of deck 16, as shown.

It should be noted at this point that orientational terms such as above, raise, and lower refer to the subject drawing as viewed by an observer. The drawing figures depict their subject matter in orientations of normal use, which could obviously change with changes in body posture and position. Therefore, orientational terms must be understood to provide semantic basis for purposes of description only, and do not imply that their subject matter can be used only in one position.

Chassis 102 may comprise a plate, an open space frame, a combination of these, or any structure to which other components of wave generator 100 may be directly or ultimately anchored. As illustrated, the environmental support may comprise a base 118 including a bottom surface 120 for resting on a horizontal planar environmental surface, such as a deck 16 of a swimming pool (not shown in its entirety). Alternatively, base 118 may present sufficient patches of contact as to operate like a large, continuous, two dimensional surface.

Alternatively, the environmental support may comprise a clamp, which could be used for example to fix wave generator 100 to the gunwhale of a boat, stakes for penetrating the earth, straps for surrounding an environmental object (planar bottom surface 120 is the only form of engagement shown), or may take other forms as desired.

Post 110 acts as a fulcrum about which rocker arm 104 rocks or oscillates, e.g., about a pin 122, and is directly or ultimately fixed to chassis 102. Oscillating motion at proximal end 106 results in oppositely directed motion at distal end 108, thereby causing agitator 114 to periodically impinge against and penetrate surface 10 of body of water 12. This causes waves to propagate away from agitator 114.

Oscillating device 112 may comprise a crank 124 including a shaft 126 and a journal 128 fixed to and offset from shaft 126, a motor 130 rotatably coupled to shaft 126, and a connecting rod 132 coupled to journal 128 and to rocker arm 104 such that rotation of crank 124 causes rocker arm 104 to raise and lower agitator 114 relative to surface 10 of body of water 12. Connecting rod 132 may be pivotally coupled to connecting rod 104 by a pin 133.

Because the Drawing Figures are schematic, they do not necessarily illustrate actual construction of 100 which might be contemplated. For example, as shown, motor 130 is fixed to shaft 126. In actual practice, gears, pulleys, or other couplings (none are shown) may be interposed between shaft 126 and motor 130 to make the input of motor 130 accord with desired output characteristics of shaft 126.

Wave generator 100 may further comprise a vertically oriented support arm 134 pivotally coupled to rocker arm 104 at one end of vertically oriented support arm 134 and coupled to agitator 114 at an opposed end of vertically oriented support arm 134. Wave generator 100 may further comprise an adjustment mechanism enabling agitator 114 to be positioned selectively at a variety of distance intervals from rocker arm 104. The adjustment mechanism may comprise a series of holes 136 in vertically oriented support arm 134 and a pin 138 securing vertically oriented support arm 134 to rocker arm 104. Pin 138 is occupies a selected hole 136 and is fastened in place by a suitable threaded fastener (not shown).

Figure 4:
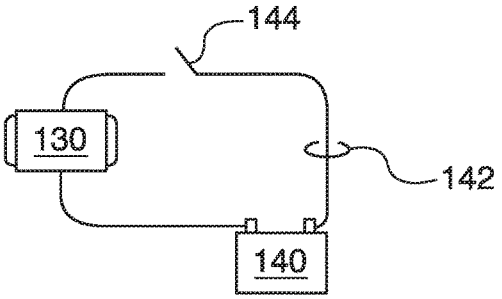
FIG. 4 is an electrical schematic diagram of powered components of the wave generator of FIG. 1, according to at least one aspect of the disclosure.

Motor 130 may be an electric motor. Referring also to FIG. 4, oscillating mechanism may further comprise a battery 140 and circuitry 142 electrically connecting battery 140 to motor 130. Wave generator 100 may further comprise a switch 144 configured to open and close circuitry 142. Switch 144 may be located on the exterior of wave generator 100. Wave generator 100 may further comprise a flexible cover 146 covering 102 chassis and oscillating device 112. Cover 146 may visually simulate an aquatically themed object. The aquatically themed object may be a marine animal. The marine animal may be a whale (as illustrated) or a fish, for example. Cover 146 may comprise an openable closure 148 providing access to oscillating device 112 when closure 148 is opened. Cover 146 may be made from a flexible or rubbery substance such as a suitable plastic or silicon material. Flexibility both accommodates bending as rocker arm 104 rocks, and also prevents injuries should a person abruptly contact cover 146. A handle 150 may facilitate opening closure 148.

As seen in FIG. 2, cover 146 includes a body appendage of the marine animal, and rocker arm 104 (FIG. 1) is contained within the body appendage.

Wave generator 100 may further comprise a water resistant housing 152 (FIG. 3) enclosing oscillating device 112. This is especially desirable where oscillating device 112 comprises electrical components.

Bottom surface 120 of base 118 may include at least three points defining a horizontal plane able to support wave generator 100 stably when wave generator 100 is placed on a planar horizontal supporting surface such as deck 10. Alternatively stated, it is not necessary that bottom surface 120 cover the entirety of the bottom of base 118. It is sufficient to establish three points of contact with the supporting surface to prevent teetering of wave generator 100.

Wave generator 100 may further comprise a cage 154 (FIGS. 1 and 2) supported from base 118 below agitator 114 when base 118 of wave generator 100 rests above the environmental horizontal surface. Cage 154 may be configured to surround and receive agitator 114 when agitator 114 is lowered into body of water 12 by rocker arm 104. Cage 154 may comprise a mostly open mesh, or alternatively stated, has greater voids than solid area, to accommodate displacement of water.

It should be understood that the various examples of the apparatus(es) disclosed herein may include any of the components, features, and functionalities of any of the other examples of the apparatus(es) disclosed herein in any feasible combination, and all of such possibilities are intended to be within the spirit and scope of the present disclosure. Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

I claim:

1. A wave generator for generating waves on the surface of a body of water when supported on an environmental object proximate the body of water, the wave generator comprising:

a chassis including an environmental support configured to engage the environmental object and secure the wave generator stably thereto;

a rocker arm including a proximal end and a distal end, and a post pivotally supporting the rocker arm above the chassis such that the distal end of the rocker arm extends laterally beyond the chassis;

an oscillating device supported by the chassis and coupled to the rocker arm between the proximal end of the rocker arm and the post;

an agitator depending from the rocker arm between the post and the distal end of the rocker arm, the agitator configured to present a contact surface for generating a wave responsive to the agitator being projected into the surface of the body of water; and a flexible cover covering the chassis and the oscillating device, wherein the flexible cover visually simulates a marine animal, the flexible cover including a body appendage of the marine animal, and wherein the rocker arm is contained within the body appendage.

2. The wave generator of claim 1, wherein the environmental support comprises a base including a bottom surface for resting on a horizontal planar environmental surface.

3. The wave generator of claim 1, further comprising a vertically oriented support arm pivotally coupled to the rocker arm at one end of the vertically oriented support arm and coupled to the agitator at an opposed end of the vertically oriented support arm.

4. The wave generator of claim 3, further comprising an adjustment mechanism enabling the agitator to be positioned selectively at a variety of distance intervals from the rocker arm.

5. The wave generator of claim 4, wherein the adjustment mechanism comprises a series of holes in the vertically oriented support arm and a pin securing the vertically oriented support arm to the rocker arm.

6. The wave generator of claim 1, wherein the oscillating device comprises a crank including a shaft and a journal fixed to and offset from the shaft, a motor rotatably coupled to the shaft, and a connecting rod coupled to the journal and to the rocker arm such that rotation of the crank causes the rocker arm to raise and lower the agitator relative to the surface of the body of water.

7. The wave generator of claim 6, wherein the motor is an electric motor, the oscillating device further comprising a battery and circuitry electrically connecting the battery to the motor.

8. The wave generator of claim 7, further comprising a switch configured to open and close the circuitry, the switch located on the exterior of the wave generator.

9. The wave generator of claim 1, wherein the bottom surface of the base includes at least three points defining a horizontal plane able to support the wave generator stably when the wave generator is placed on a planar horizontal supporting surface.

10. The wave generator of claim 1, further comprising a cage supported from the base below the agitator when the base of the wave generator rests above the environmental horizontal surface, wherein the cage is configured to surround and receive the agitator when the agitator is lowered into the body of water by the rocker arm.

11. The wave generator of claim 1, wherein the flexible cover comprises an openable closure providing access to the oscillating device when the openable closure is open.

12. The wave generator of claim 1, wherein the marine animal is a fish or a whale.

* * * * *